US006681966B2

(12) United States Patent
Gouldson et al.

(10) Patent No.: US 6,681,966 B2
(45) Date of Patent: Jan. 27, 2004

(54) AUTOMATED METHODS AND DEVICES FOR REMOVING A SIZE INDICATOR FROM A GARMENT HANGER HAVING A REMOVABLE SIZE INDICATOR

(75) Inventors: Stanley F. Gouldson, Northport, NY (US); Olaf F. Olk, Hauppauge, NY (US)

(73) Assignee: Spotless Plastics Pty. Ltd., Victoria (AU)

( * ) Notice: Subject to any disclaimer, the term of this patent is extended or adjusted under 35 U.S.C. 154(b) by 0 days.

(21) Appl. No.: 10/196,981

(22) Filed: Jul. 17, 2002

(65) Prior Publication Data

US 2003/0136804 A1 Jul. 24, 2003

Related U.S. Application Data

(60) Continuation-in-part of application No. 10/043,346, filed on Jan. 11, 2002, now Pat. No. 6,499,634, which is a division of application No. 09/827,072, filed on Apr. 5, 2001, now Pat. No. 6,378,744, which is a continuation-in-part of application No. 09/479,170, filed on Jan. 7, 2000, now Pat. No. 6,264,075, application No. 10/196,981, which is a continuation-in-part of application No. 10/186,449, filed on Jul. 1, 2002, which is a continuation of application No. 09/255,135, filed on Feb. 19, 1999, now Pat. No. 6,421,910, which is a division of application No. 08/875,508, filed on Feb. 2, 1996, now Pat. No. 6,289,569.

(51) Int. Cl.[7] ..... A47G 25/14
(52) U.S. Cl. ..... 223/85; 40/322
(58) Field of Search ..... 223/85, 88, 92, 223/95; 40/322

(56) References Cited

U.S. PATENT DOCUMENTS

| | | | |
|---|---|---|---|
| 1,321,926 | A | 11/1919 | Landry |
| 1,389,266 | A | 8/1921 | Newton |
| 2,166,492 | A | 7/1939 | Harvey |
| 2,857,696 | A | 10/1958 | Barrow |
| D192,845 | S | 5/1962 | Cohen |
| 3,535,808 | A | 10/1970 | Morrish |
| 3,949,914 | A | 4/1976 | Ostroll |
| 4,006,547 | A | 2/1977 | Samuels et al. |
| 4,045,899 | A | 9/1977 | Richardson |
| 4,115,940 | A | 9/1978 | Phillips |

(List continued on next page.)

*Primary Examiner*—Bibhu Mohanty
(74) *Attorney, Agent, or Firm*—Scully, Scott, Murphy & Presser

(57) ABSTRACT

A method for removing a releasable size indicator from a garment hanger. The garment hanger including: a body having at least one web for removably securing a size indicator to the body, the web having a fixed latch and a pivoting latch; and a size indicator having finger means for engaging the fixed and pivoting latches. The method including: (a) feeding the garment hanger to an indicator removal station; (b) supporting the garment hanger at the indicator removal station for removal of the size indicator; (c) depressing the pivoting latch to pivot the same out of engagement with the finger means to release the size indicator from the web; (d) collecting the released size indicator; (e) removing the garment hanger from the indicator removal station; and (f) repeating steps (a) to (e) for each of a plurality of hangers sequentially fed to the indicator removal station.

10 Claims, 14 Drawing Sheets

U.S. PATENT DOCUMENTS 4,198,773 A 4/1980 Batts et al.
4,322,902 A 4/1982 Lenthall
4,450,639 A 5/1984 Duester
4,997,114 A 3/1991 Petrou
5,096,101 A 3/1992 Norman et al.
5,199,608 A 4/1993 Zuckerman
5,238,159 A 8/1993 Zuckerman
5,305,933 A 4/1994 Zuckerman
5,383,583 A 1/1995 Zuckerman
5,388,354 A 2/1995 Marshall et al.
5,407,109 A 4/1995 Zuckerman
5,441,182 A 8/1995 Sullivan
5,449,099 A 9/1995 Blanchard
5,469,995 A 11/1995 Bredeweg et al.
5,477,995 A 12/1995 Dooley et al.
5,485,943 A 1/1996 Zuckerman
5,503,310 A 4/1996 Zuckerman
5,524,801 A 6/1996 Dooley et al.
5,573,151 A 11/1996 Fildan
5,586,697 A 12/1996 Johansson
5,590,822 A 1/1997 Zuckerman
5,597,100 A 1/1997 Blitz
5,603,437 A 2/1997 Zuckerman
5,611,469 A 3/1997 Eiley et al.
5,613,629 A 3/1997 Zuckerman
5,641,100 A 6/1997 Mitchell et al.
5,642,840 A 7/1997 Abdi
5,683,018 A 11/1997 Sullivan et al.
5,687,887 A 11/1997 Bond et al.
5,775,553 A 7/1998 Marshall et al.
5,778,575 A 7/1998 Deupree et al.
5,819,995 A 10/1998 Zuckerman
5,857,276 A 1/1999 Marshall et al.
5,913,462 A 6/1999 Petrou
5,944,237 A * 8/1999 Gouldson ..... 223/85
5,950,883 A 9/1999 Bond et al.
6,019,260 A 2/2000 Gouldson et al.
6,029,868 A 2/2000 Willinger et al.
6,041,983 A 3/2000 Sullivan et al.

* cited by examiner

AUTOMATED METHODS AND DEVICES FOR REMOVING A SIZE INDICATOR FROM A GARMENT HANGER HAVING A REMOVABLE SIZE INDICATOR

CROSS REFERENCE TO RELATED APPLICATIONS

This application is a continuation-in-part of U.S. application Ser. No. 10/043,346 filed Jan. 11, 2002 now U.S. Pat. No. 6,499,634, which is a divisional of U.S. application Ser. No. 09/827,072 filed Apr. 5, 2001 now U.S. Pat. No. 6,378,744, which is a continuation-in-part of U.S. application Ser. No. 09/479,170, filed Jan. 7, 2000, now U.S. Pat. No. 6,264,075. This application is also a continuation-in-part of U.S. application Ser. No. 10/186,449 filed Jul. 1, 2002, which is a continuation of U.S. application Ser. No. 09/255,135 filed Feb. 19, 1999 now U.S. Pat. No. 6,421,910, which is a divisional of U.S. application Ser. No. 08/875,508 filed Feb. 2, 1996 now U.S. Pat. No. 6,289,569.

BACKGROUND OF THE INVENTION

1. Field of the Invention

The present invention relates generally to garment hangers having a removable size indicator and, more particularly, to an automated means for removing the size indicator from the garment hanger.

2. Prior Art

For purposes of displaying garments suspended on hangers in an orderly and attractive manner to the retail customer, it is often desired to affix an indicating means on the hanger in a position visible to the retail customer while the hanger is suspended on a rack. The indicating means identifies some attribute of the garment suspended from the hanger, such as size, quality, color, manufacturing data, or pattern.

The provision of a readily visible size indicator on a garment hanger is now accepted by retailers as a desirable addition to the garment hanger. To accommodate the various types of hangers available in the industry, numerous indicating means have been developed in a variety of shapes, sizes and materials. Similarly, hangers have been developed to accommodate a variety of different indicating means.

The size indicators can be positioned at different locations on the hanger, such as the top and side and can also be inserted on the hanger in an automated fashion. Furthermore, it is increasingly common for customers to require that the indicator be removable from the hanger for re-use with other sized garments or re-location.

SUMMARY OF THE INVENTION

It is an object of the present invention to provide automated methods and devices for removing releasable size indicators from garment hangers.

Accordingly, a method for removing a releasable size indicator from a garment hanger is provided where the garment hanger comprises: a body having at least one web for removably securing a size indicator to the body, the web having a fixed latch and a pivoting latch; and a size indicator having finger means for engaging the fixed and pivoting latches such that the size indicator is secured on the web during normal use, but wherein the size indicator may be released from the web when the pivoting latch is pivoted out of engagement with the finger means of the size indicator. The method comprises: (a) feeding the garment hanger to an indicator removal station; (b) supporting the garment hanger at the indicator removal station for removal of the size indicator; (c) depressing the pivoting latch to pivot the same out of engagement with the finger means to release the size indicator from the web; (d) collecting the released size indicator; (e) removing the garment hanger from the indicator removal station; and (f) repeating steps (a) to (e) for each of a plurality of hangers sequentially fed to the indicator removal station.

Preferably, the feeding comprises feeding the garment hanger on a feeding rail to the indicator removal station. The supporting preferably comprises supporting the garment hanger at the indicator removal station at a location on the feeding rail. Alternatively, the supporting comprises supporting the garment hanger at the indicator removal station at a location remote from the feeding rail. Preferably, the depressing comprises actuating a cylinder having a pin attached thereto, the pin engaging the pivoting latch upon actuation of the cylinder.

Also provided is an apparatus for removing a releasable size indicator from the garment hanger. The apparatus comprising: (a) means for feeding the garment hanger to an indicator removal station; (b) means for supporting the garment hanger at the indicator removal station for removal of the size indicator; (c) means for depressing the pivoting latch to pivot the same out of engagement with the finger means to release the size indicator from the web; (d) means for collecting the released size indicator; (e) means for removing the garment hanger from the indicator removal station; and (f) means for repeating the release and collection of size indicators for each of a plurality of hangers sequentially fed to the indicator removal station.

Preferably, the means for feeding comprises means for feeding the garment hanger on a feeding rail to the indicator removal station. The indicator removal station is preferably located at a location on the feeding rail, or alternatively at a location remote from the feeding rail. Preferably, the means for depressing comprises a cylinder having a pin attached thereto, the pin engaging the pivoting latch upon actuation of the cylinder.

BRIEF DESCRIPTION OF THE DRAWINGS

These and other features, aspects, and advantages of the apparatus of the present invention will become better understood with regard to the following description, appended claims, and accompanying drawings where:

FIG. 2(*b*) illustrates a top view of the size indicator of FIG. 2(*a*).

FIG. 3(*b*) illustrates the enlarged view of the web of FIG. 3*a* with a size indicator secured thereon.

FIG. 6(*b*) illustrates a partial sectional view of the web of FIG. 3 as taken along line 5—5 thereof and additionally having the second version of the size indicator secured thereon.

FIG. 7(*b*) illustrates the first web and second version of the first embodiment of the size indicator of FIG. 6(*b*) wherein the pivoting latch is being pivoted to release the size indicator therefrom.

FIG. 9(*b*) illustrates a side view of the size indicators of FIGS. 9(*a*) and 9(*c*).

DETAILED DESCRIPTION OF THE PREFERRED EMBODIMENT

Figure 1:
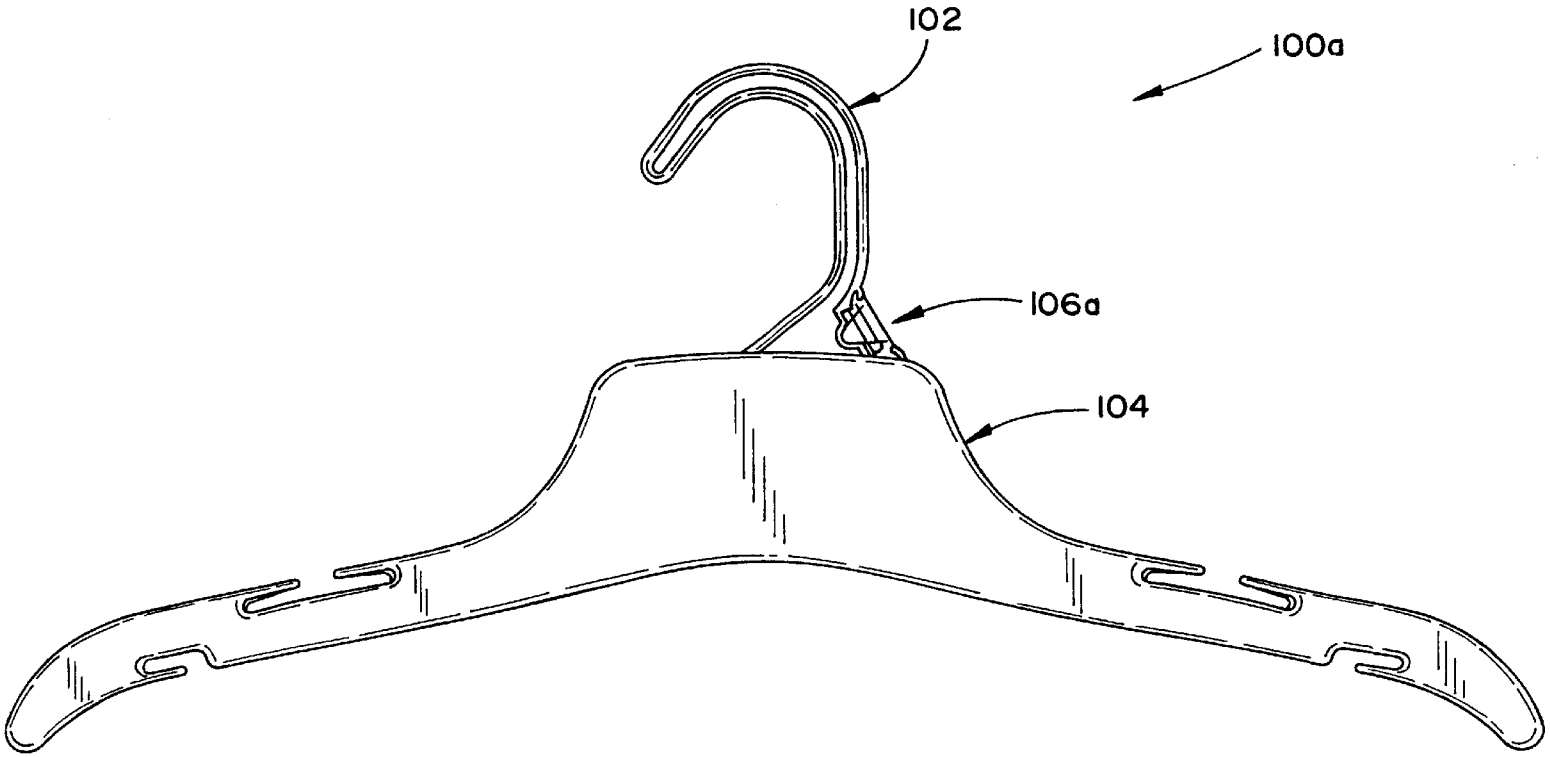
FIG. 1 illustrates a first embodiment of a garment hanger of the present invention having a first web at a junction between the hook and body of the garment hanger.
Figure 8:
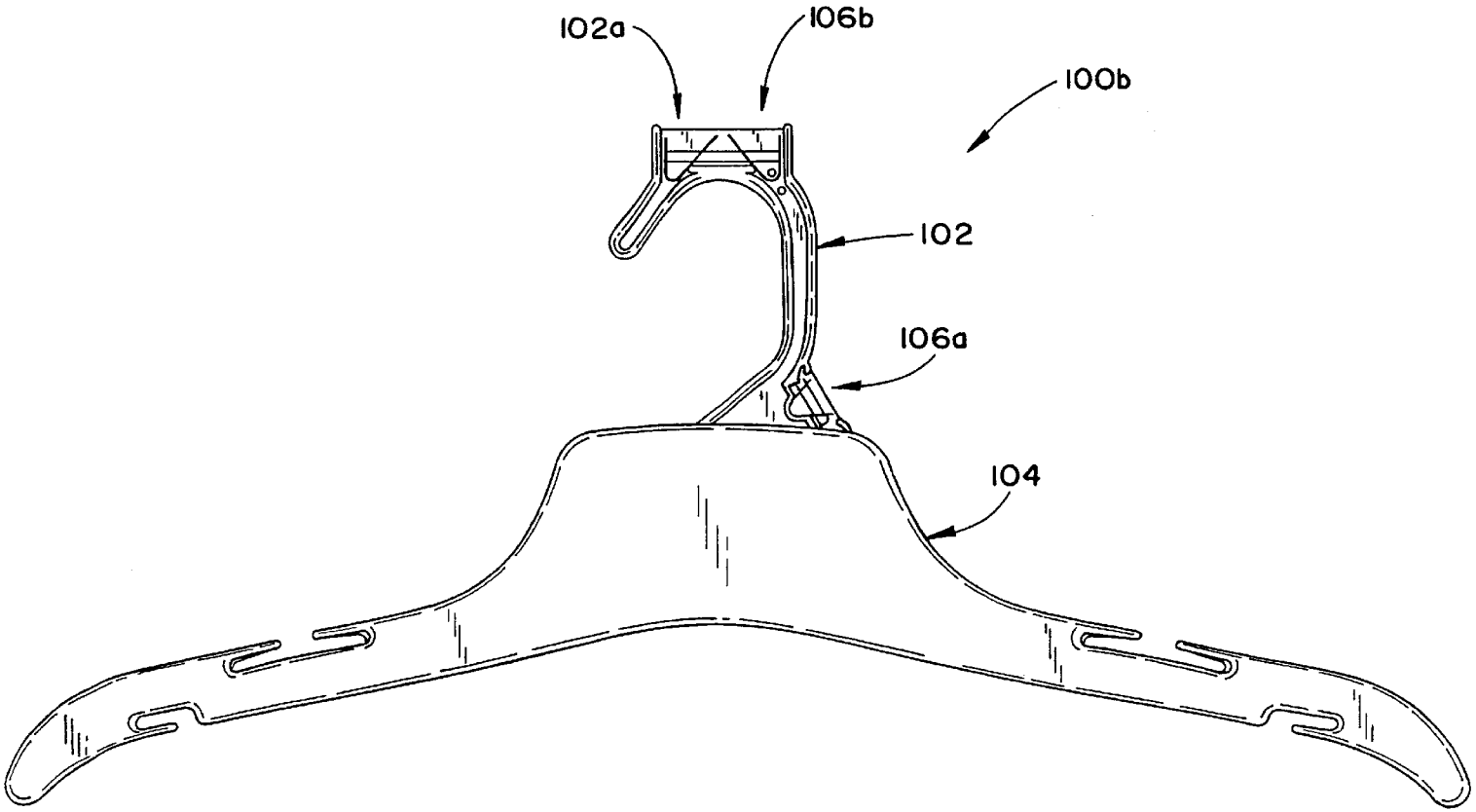
FIG. 8 illustrates a second embodiment of a garment hanger of the present invention having the first web at a junction between the hook and body of the garment hanger and a second web at a top portion of the hook.

Referring now to FIG. 1, there is illustrated a first embodiment of the garment hanger of the present invention, generally referred to by reference numeral 100*a*. The garment hanger 100*a* has a hanging means, such as a hook 102, for supporting the hanger 100*a* on a display (not shown). The hanger 100*a* further having a body 104 connected to the hook 102. The body has at least one web 106*a* for removably securing a first version of a first embodiment of a size indicator 108*a* (FIG. 2*a*) to the body 104. In a first embodiment of the garment hanger of the present invention, illustrated in FIG. 1, the web 106*a* is located at a junction between the hook 102 and the body 104. As will be discussed below with regard to FIG. 8, in a second embodiment of the garment hanger of the present invention, generally referred to by reference numeral 100*b*, the web 106*b* can be alternatively located at a top portion 102*a* of the hook 102. Furthermore, as will be discussed below with regard to FIG. 11, in a third embodiment of the garment hanger of the present invention, generally referred to by reference numeral 100*c*, the web 106*b* can be alternatively located at both the junction between the hook 102 and the body 104 and at the top portion 102*a* of the hook 102.

Figure 3B:
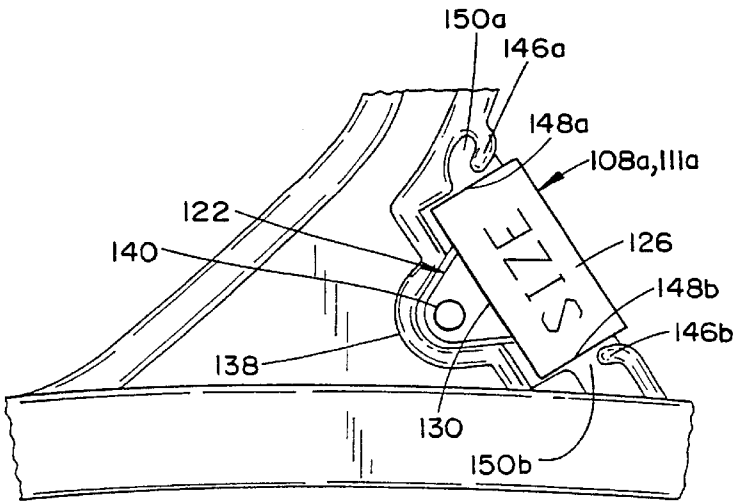
FIG. 3(*a*) illustrates an enlarged view of the first web of FIG. 1.
Figure 3A:
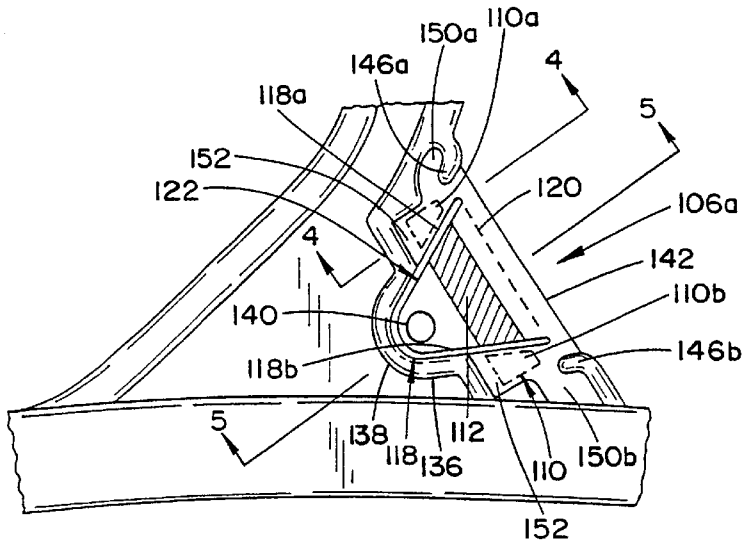
Figure 4:
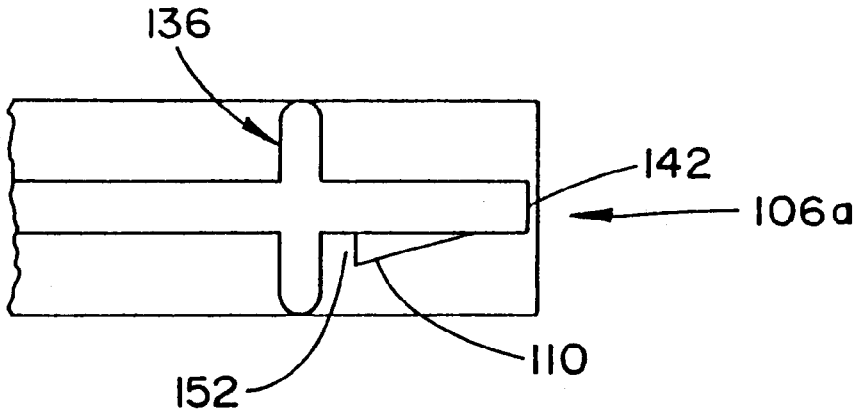
FIG. 4 illustrates a partial sectional view of the first web of FIG. 3 as taken along line 4—4 thereof.
Figure 5:
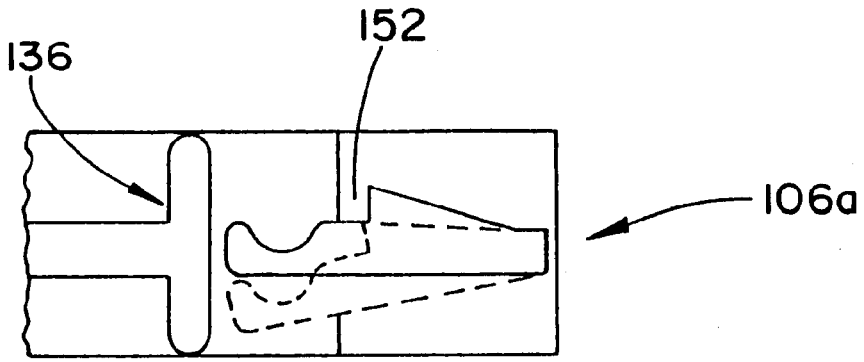
FIG. 5 illustrates a partial sectional view of the web of FIG. 3. as taken along line 5—5 thereof, the movement of the pivoting latch illustrated therein by a broken line.

Referring Now to FIG. 3*a*, the web has a fixed latch 110 and a pivoting latch 112. The pivoting latch 112 is preferably located at a central portion of the web 106*a* and the fixed latch 110 is located on at least one end of the pivoting latch 112. Preferably, the fixed latch 110, as shown in FIG. 3, comprises two abutments 110*a*, 110*b* located on each end of the pivoting latch 112. As illustrated in FIGS. 4–7, and most clearly in FIGS. 6*a* and 6*b*, it is also preferable that the pivoting latch 112 projects from a first side 114 of the web 106*a* and the fixed latch 110 projects from an opposite side 116 of the web 106*a*.

Referring back to FIG. 3*a*, the pivoting latch 112 is preferably defined by a slot 118 cut through the web 106*a*. The slot preferably has a shape defined by at least two sides 118*a*, 118*b*. The pivoting latch 112 is further defined by a living hinge, shown by dotted line 120 closing the shape of the slot 118. As shown in FIG. 3*a*, the slot 118 is preferably substantially two sided 118*a*, 118*b* and the living hinge 120 closes the shape of the slot 118 thereby forming a triangular shaped pivoting latch 112. It should be apparent to those skilled in the art that the pivoting latch and the slot defining the shape thereof, can have a variety of shapes, such as rectangular, without departing from the scope or spirit of the present invention.

Figure 6A:
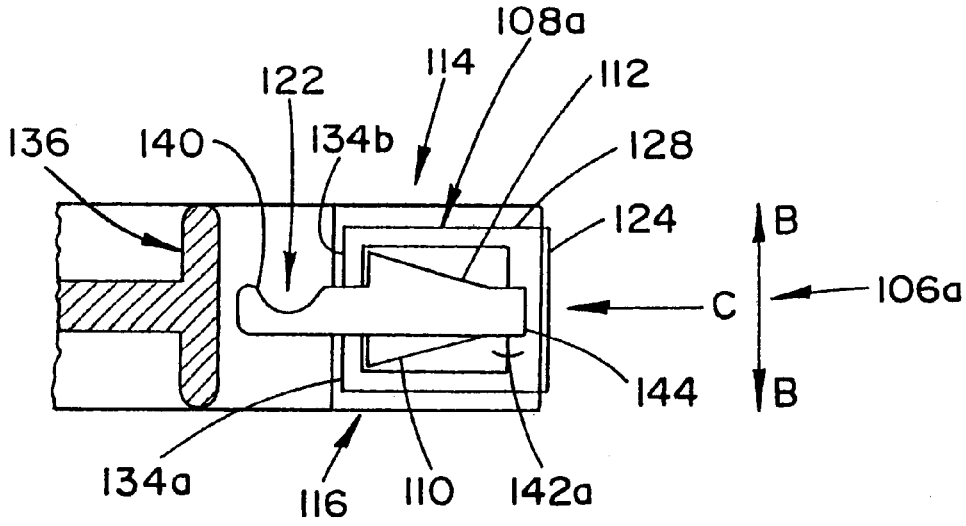
FIG. 6(*a*) illustrates a partial sectional view of the web of FIG. 3 as taken along line 5—5 thereof and additionally having the first version of the size indicator secured thereon.
Figure 7A:
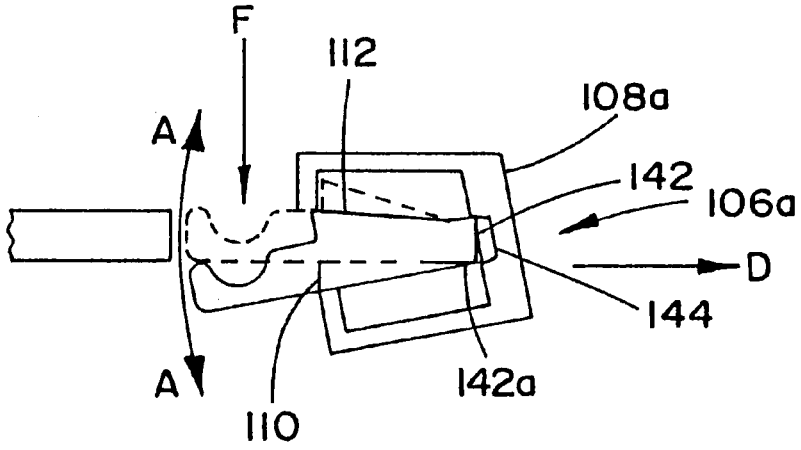
FIG. 7(*a*) illustrates the first web and first version of the first embodiment of the size indicator of FIG. 6(*a*) wherein the pivoting latch is being pivoted to release the size indicator therefrom.
Figure 7B:
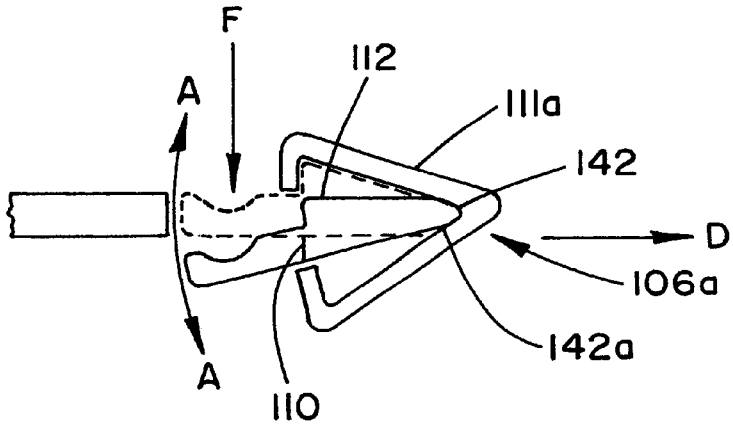

Referring now to FIGS. 3*a*, 3*b*, and 6*a* in combination, the pivoting latch 112 preferably has an engagement means for facilitating movement of the pivoting latch about arrow A shown in FIGS. 7*a* and 7*b*. The engagement means preferably comprises a cantilevered end 122 of the pivoting latch 112 which when a releasing force (F) is applied thereto provides a mechanical advantage for movement of the pivoting latch 112 out of engagement with the size indicator. Simultaneously, the opposite side of the pivoting latch 112 displaces the size indicator such that it no longer engages the fixed latch 110.

Figure 2C:
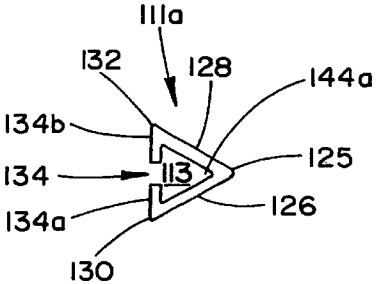
FIGS. 2(*a*) and 2(*c*) illustrate an end view of a first and second version, respectively, of a first embodiment of a size indicator of the present invention for engaging the first web of FIG. 1.
Figure 2B:
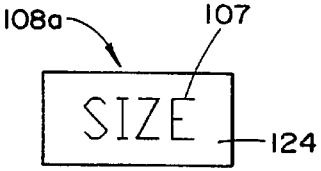
Figure 2A:
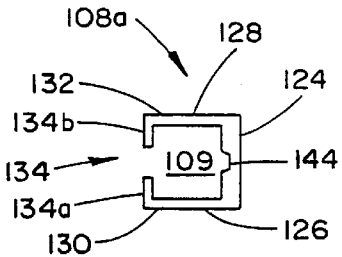

Referring now to FIGS. 2*a*, 2*b*, and 6*a* in combination, a first version of the size indicator 108*a* of the first embodiment generally has a face 124 and two sides 126, 128 depending therefrom to form a generally C-shaped channel 109. Each of the sides 126, 128 terminate in a foremost edge 130, 132. The foremost edges 130, 132 are preferably configured such that the cantilevered end 122 of the pivoting latch 112 is exposed when the size indicator 108*a* is secured on the web 106*a*.

The size indicator 108*a* further having finger means 134 for engaging the fixed and pivoting latches 110, 112, respectively, such that the size indicator 108*a* is secured on the web during normal use. However, the size indicator 108*a* is releasably secured on the web 106*a* such that it may be released from the web 106*a* when the pivoting latch 112 is pivoted out of engagement with the finger means 134 of the size indicator 108*a* when the release force (F) is applied. The finger means 134 preferably comprises an inwardly facing ridge 134*a*, 134*b* disposed at each of the foremost edges 130, 132 and projecting inwards towards the channel 109 of the size indicator 108*a*.

In an alternative version, a second size indicator of the first embodiment is illustrated in FIG. 2*c* in which like reference numerals refer to similar features, the second size indicator being referred to generally by reference numeral 111*a*. The second size indicator 111*a* generally has two sides 126, 128 depending from an apex 125 to form a generally V-shaped channel 113. Each of the sides 126, 128 terminate in a foremost edge 130, 132. The foremost edges 130, 132 are preferably configured such that the cantilevered end 122 of the pivoting latch 112 is exposed when the size indicator 111*a* is secured on the web 106*a*. The size indicator 111*a* further having finger means 134 for engaging the fixed and pivoting latches 110, 112, respectively, such that the size indicator 111*a* is secured on the web during normal use. However, the size indicator 111*a* is releasably secured on the web 106*a* such that it may be released from the web 106*a* when the pivoting latch 112 is pivoted out of engagement with the finger means 134 of the size indicator 111*a* when the release force (F) is applied. The finger means 134 preferably comprises an inwardly facing ridge 134*a*, 134*b* disposed at each of the foremost edges 130, 132 and projecting inwards towards the V-shaped channel 113 of the size indicator 111*a*.

Referring back to FIGS. 3*a* and 6*a* in combination, the web preferably also has a guard 136 extending across the web 106*a* and below the size indicator 108*a*. In a preferred implementation, the guard 136 has a down-turned portion 138 which follows the contours of the cantilevered end 122 to thereby enable access to the edges of the size indicator and the engagement means 122 but prevents inadvertent actuation of the pivoting latch 112. The cantilevered end and engagement means 122 are preferably configured to engage a tool (not shown) used for application of the releasing force (F). The engagement means is preferably a dimple 140 formed on a side of the cantilevered end 122. The tool having a tip substantially conforming to the shape of the dimple 140 and having a width such that it is not prevented from engaging the dimple 140 by the guard 136.

The web preferably also has an outermost edge 142 having an outermost portion 142*a* of a predetermined cross-section. The first version of the size indicator 108*a* having a trough 144 (FIG. 2*a*) with a mating cross-section substantially configured to receive the outermost portion 142*a* therein for preventing a lateral movement of the size indicator along direction B—B when the size indicator 108*a* is secured on the web 106*a*. The preferable predetermined cross-section of both the outermost portion 142*a* and the trough 144 is substantially rectangular. In the second version of the size indicator 111*a* the inner portion of the apex 125 forms a trough 144*a* which is shaped such that the outermost portion 142*a* is accepted therein when the size indicator 111*a* is secured on the web 106*a* to prevent lateral movement of the size indicator 111*a* along direction B—B (illustrated in FIG. 6*b*).

Referring to FIG. 3*b*, the web 106*a* further comprises locating means for locating the size indicator 108*a*, 111*a* in a predetermined position on the web 106*a*. The locating means preferably comprises first and second guides 146*a*, 146*b* disposed adjacent each side edge 148*a*, 148*b* of the size indicator 108*a*, 111*a* and spaced apart to align the size indicator 108*a*, 111*a* therebetween and to center the size indicator 108*a*, 111*a* during application thereof on the web 106*a*. Preferably, the first and second guides 146*a*, 146*b* do not extend the full length of the side edges 148*a*, 148*b* of the size indicator but define elongate openings 150*a*, 150*b* which expose the side edges 148*a*, 148*b* of the size indicator.

Referring now to FIGS. 6*a* and 7*a*, the operation of the garment hanger 100*a* of the present invention will be explained with regard to size indicator 108*a*. Size indicator 108*a* is mounted on the web 106*a* by sliding it over web 106*a* in the direction of arrow C. While being mounted in the direction of arrow C, the pivoting latch 112 pivots in the direction of arrow A until the inwardly facing ridges 134*a*, 134*b* of finger means 134 pass over the fixed and pivoting ridges 110, 112. After which, the inwardly facing fingers 134*a*, 134*b* snap into place in an area defined by the guide 136 and a bottom edge of the fixed and pivoting ridges 110, 112, the area being referenced by reference numeral 152 (illustrated in FIGS. 4 and 5). As such, the size indicator 108*a* is releasably secured on the web 106*a*.

Figure 6B:
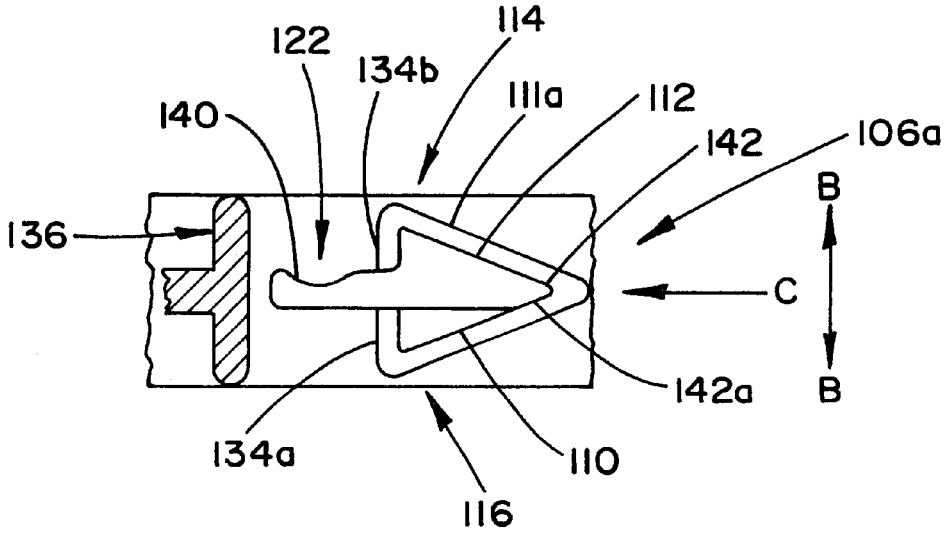

Referring now to FIGS. 6*b* and 7*b*, the operation of the garment hanger 100*a* of the present invention will be explained with regard to second version of the first embodiment of the size indicator 111*a*. Similar to the manner in which size indicator 108*a* is mounted, size indicator 111*a* is mounted on the web 106*a* by sliding it in the direction of arrow C over web 106*b*. While being mounted in the direction of arrow C, the pivoting latch 112 pivots in the direction of arrow A until the inwardly facing ridges 134*a*, 134*b* of finger means 134 pass over the fixed and pivoting ridges 110, 112. After which, the inwardly facing fingers 134*a*, 134*b* snap into place in an area defined by the guide 136 and a bottom edge of the fixed and pivoting ridges 110, 112, the area being referenced by reference numeral 152 (illustrated in FIGS. 4 and 5).

To release the size indicators 108*a*, 111*a* from the web 106*a*, a releasing force (F) is applied to the cantilevered end 122 of the pivoting latch 112, preferably by engaging the dimple 140 thereon with a release tool (not shown). The release force (F) results in the pivoting latch 112 to pivot about the living hinge 120 in the direction of arrow A. As can be seen in FIGS. 7*a* and 7*b*, planar side wall of the pivoting latch 112 causes the inner ridge 134*a* of the finger means 134 of size indicators 108*a*, 111*a* to extend past the furthest extending portion of the fixed latch 110. At this point, the size indicator 108*a*, 111*a* may be manually removed from the web 106*a*.

Preferably, the size indicators 108*a*, 111*a* are fabricated from a resilient material and thereby the sides 126, 128 may be slightly biased towards each other. Thus, when the side 126 of the size indicator 108*a*, 111*a* extends past the furthest extending portion of the fixed latch 110 the resilient bias of the size indicator 108*a*, 111*a* pops the size indicator off of the web automatically, without further manual intervention.

Preliminary testing of the releasable size indicators 108*a*, 111*a* of the present invention has indicated that a force of approximately 25–30 pounds is needed to pull the size indicators from the latches of the web. Thus, the size indicators 108*a*, 111*a* of the present invention are considered to be child-proof, since industry standards require a minimum force of 15 pounds to pull off a size indicator from a hanger for the size indicator to be considered child-proof.

Referring now to FIGS. 8, 9*a*, 9*b*, and 10, there is illustrated a second embodiment of the garment hanger of the present invention, generally referred to by reference numeral 100*b* and in which like reference numerals denote like elements as previously discussed. The garment hanger 100*b* differs from garment hanger 100*a* illustrated in FIG. 1 in that a second web 106*b* is disposed at a top portion 102*a* of the hook 102. Generally, the second web 106*b* differs from the first web 106*a* by the inclusion of first and second pivoting latches 212*a*, 212*b*.

Figure 10:
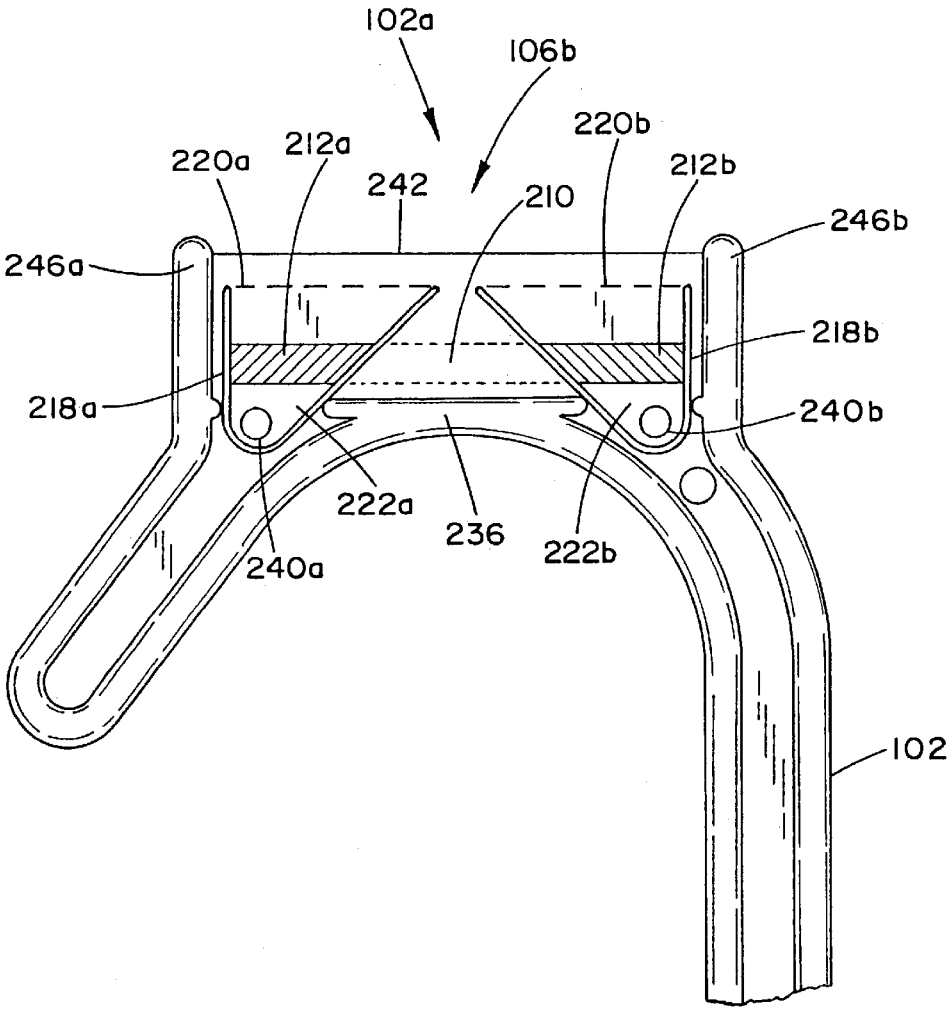
FIG. 10 illustrates an enlarged view of the second web of FIG. 1.

Referring Now to FIG. 10, the web 106*b* has a fixed latch 210 and first and second pivoting latches 212*a*, 212*b*. The fixed latch 210 is preferably located at a central portion of the web 106*b* and each of the pivoting latches 212*a*, 212*b* is located each end of the fixed latch 210. As with hanger 100*a* it is preferable that the pivoting latches 212*a*, 212*b* project from a first side of the web 106*b* and the fixed latch 210 project from an opposite side of the web 106*b*.

Referring back to FIG. 10, each pivoting latch 212*a*, 212*b* is preferably defined by a slot 218*a*, 218*b* cut through the web 106*b*. Each slot preferably has a triangular shape as discussed above with regard to hanger 100*a*. Each slot 218*a*, 218*b* is defined by a living hinge, shown by dotted lines 220*a*, 220*b* closing the shape of each slot 218*a*, 218*b*.

As discussed above with regard to hanger 100*a*, each pivoting latch 212*a*, 212*b* preferably has an engagement means for facilitating movement of the pivoting latch. The engagement means preferably comprises a cantilevered end 222*a*, 222*b* of the pivoting latch 212*a*, 212*b* which when the releasing force (F) is applied thereto provides a mechanical advantage for movement of each pivoting latch 212*a*, 212*b* out of engagement with a first or second version of a second embodiment of a size indicator 108*b*, 111*b*, respectively.

Figure 9A:
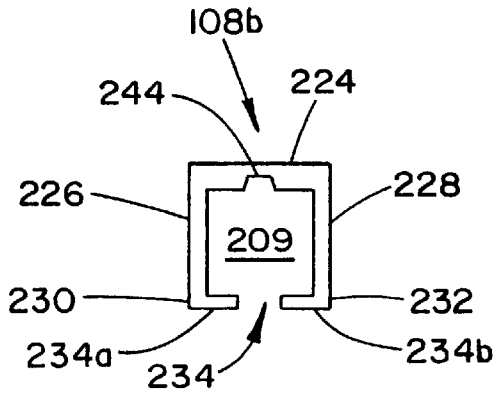
FIGS. 9(*a*) and 9(*c*) illustrate an end view of a first and second version, respectively, of a second embodiment of a size indicator of the present invention for engaging the second web of FIG. 1.
Figure 9B:
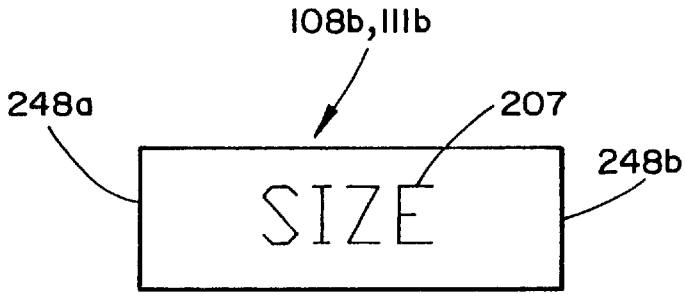

Referring now to FIGS. 9*a* and 9*b*, in combination, the first version of the second embodiment of the size indicator 108*b* generally has a face 224 and two sides 226, 228 depending therefrom to form a generally C-shaped channel 209. Each of the sides 226, 228 terminate in a foremost edge 230, 232. The foremost edges 230, 232 are preferably configured such that the cantilevered end 222*a*, 222*b* of each of the pivoting latches 212*a*, 212*b* are exposed when the size indicator 108*b* is secured on the web 106*b*.

Figure 9C:
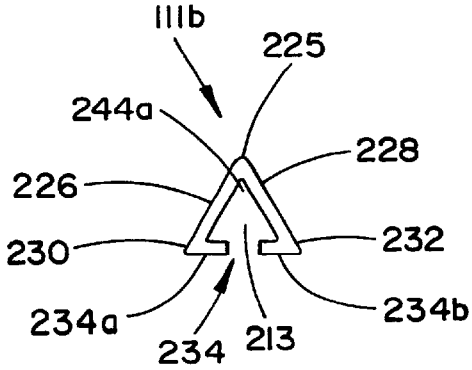

In an alternative version, a second size indicator of the second embodiment is illustrated in FIG. 9*c* in which like reference numerals refer to similar features, the second size indicator of the second embodiment being referred to generally by reference numeral 111*b*. Size indicator 111*b* having a cross-sectional shape similar to that of size indicator 111*a*, in that the side walls 226 and 228 meet at an apex 225 and define a V-shaped cavity 213.

The first and second size indicators 108*b*, 111*b* of the second embodiment further have finger means 234 for engaging the fixed and pivoting latches 210, 212*a*, and 212*b*, respectively, such that the size indicators 108*b*, 111*b* are secured on the web 106*b* during normal use. However, the size indicators 108*b*, 111*b* are releasably secured on the web 106*b* such that they may be released from the web 106*b* when both of the pivoting latches 212*a*, 212*b* are pivoted out of engagement with the finger means 234 of the size indicators 108*b*, 111*b* when a release force is applied. The finger means 234 preferably comprises inwardly facing ridges 234*a*, 234*b* disposed at each of the foremost edges 230, 232 and projecting inwards towards the channel 209, 213 of the size indicators 108*b*, 111*b*.

Although a size indication can be disposed on either the top or side surfaces of second size indicator 108*b* of the second embodiment, it is preferable that size indicator 108*a* of the first embodiment have the size indication 107 disposed on the face 124 of the size indicator 108*a* and the size indicator 108*b* of the second embodiment have the size indication 207 on both sides 226, 228 of the size indicator 108*b*. Because size indicators 111*a*, 11*b* are triangular in cross-section, the size indication 107, 207, can only be displayed on the sides thereof (126, 128 for size indicator 111*a*; 226, 228 for size indicator 111*b*).

Referring to FIG. 10, the web 106*b* preferably also has a mounting hedge 236 extending partially across the web 106*b* and below the size indicator 108*b* to provide external support for the edges 230, 232 of the size indicator. Each of the cantilevered ends and engagement means 222*a*, 222*b* are preferably configured to engage a tool (not shown) used for application of the releasing force (F). The engagement means is preferably a dimple 240*a*, 240*b* formed on a side of each of the cantilevered ends 222*a*, 222*b*. The tool being configured as described above with regard to hanger 100*a*.

The web 106*b* preferably also has an outermost edge 242 having an outermost portion as described with regard to hanger 100*a*. The size indicator 108*b* having a trough 244 (FIG. 9*a*) with a mating cross-section substantially configured to receive the outermost portion therein for preventing a lateral movement of the size indicator when the size indicator 108*b* is secured on the web 106*b*. The preferable predetermined cross-section of both the outermost portion and the trough 244 is substantially rectangular. The second version of the second embodiment of the size indicator 111*b*, like size indicator 111*a*, has a trough 244*a* which is shaped such that the outermost portion is accepted therein when the size indicator 111*b* is secured on the web 106*a* to prevent lateral movement of the size indicator 111*b* along direction B—B.

The web 106*b* further comprises locating means for locating the size indicators 108*b*, 111*b* in a predetermined position on the web 106*b*. The locating means are formed from reinforcing webs of the hanger hook and preferably comprises first and second guides 246*a*, 246*b* disposed adjacent each side edge 248*a*, 248*b* of the size indicators 108*b*, 111*b* and spaced apart to align the size indicators 108*b*, 111*b* therebetween and to center the size indicators 108*b*, 111*b* during application thereof on the web 106*b*.

The operation of the hanger 100*b* of the second embodiment of the present invention operates substantially equivalently to that of the hanger 100*a* of the first embodiment. It should be apparent to those skilled in the art that both pivoting latches 212*a*, 212*b* are pivoted by application of the release force to release the size indicators 108*b*, 111*b* from the web 106*b*.

Figure 11:
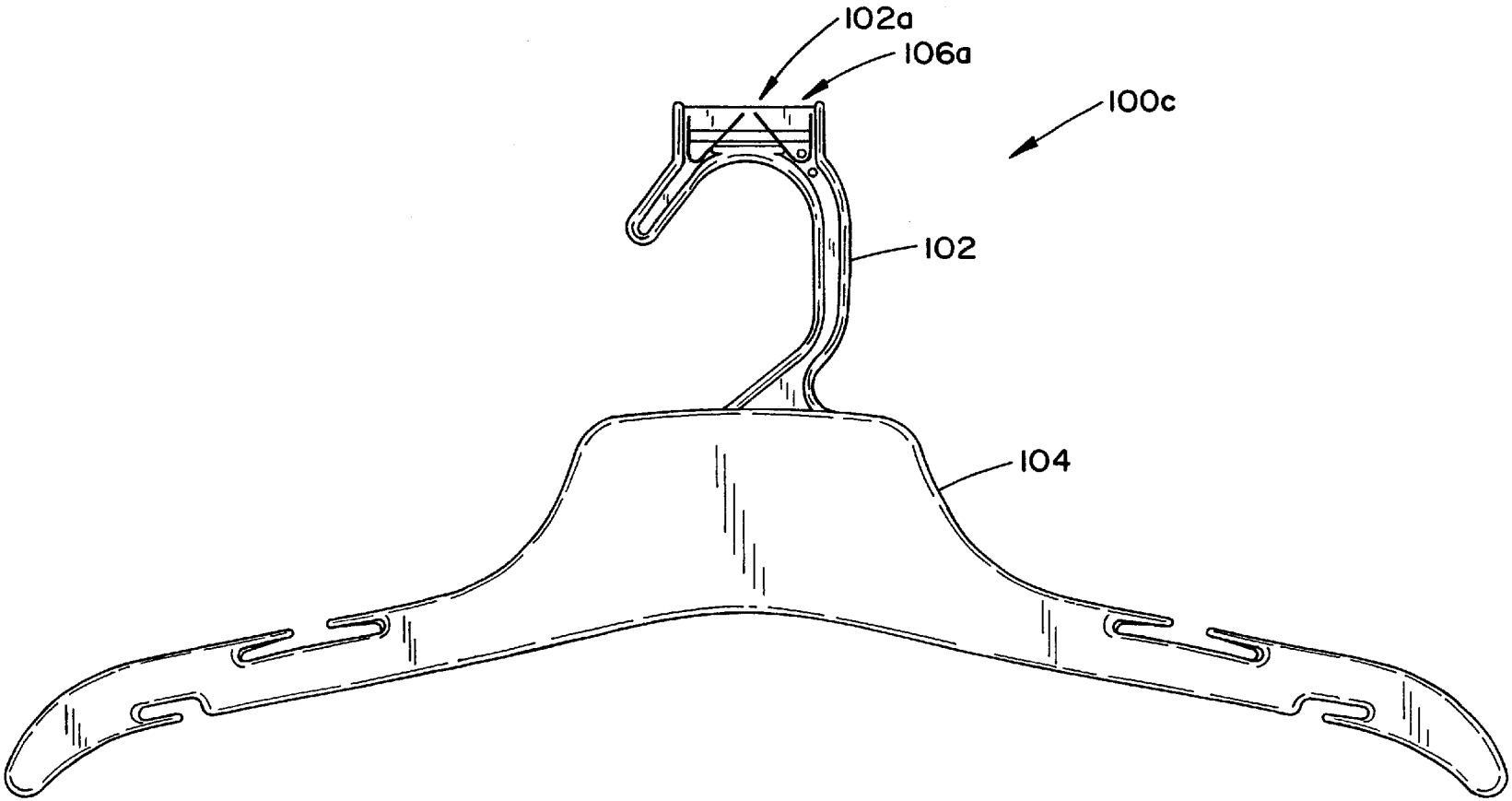
FIG. 11 illustrates a third embodiment of a garment hanger of the present invention having the second web at the top portion of the hook.

FIG. 11 illustrates a hanger of a third embodiment of the present invention generally referred to by reference numeral 100*c*. The hanger 100*c* of the third embodiment of the present invention is similar to that of the second embodiment (hanger 100*b*) with the exception of the elimination of side sizer web 106*a*.

The method and apparatus for removing the size indicator 108*a*, 111*a* from the hangers 100*a*–100*c* will be hereinafter described with respect to FIGS. 12–16. Throughout this description, the term decapping will be used to describe the removal of the size indicator 108*a*, 111 from hangers 100*a*–100*c*. Although described with respect to indicators 108*a*, 111*a*, those skilled in the art will appreciate that other size indicators used with hangers 100*a*–100*c* can also be decapped using the devices and methods disclosed herein, such as those size indicators disclosed in issued U.S. Pat. No. 6,382,478, and copending U.S. applications Ser. Nos. 09/852,189 and 10,043,346, the contents of all of which are incorporated herein by their reference. For the sake of simplicity, the hanger and size indicator will be referred to in FIGS. 12–16 by reference numerals 100*a* and 108*a*, respectively.

As discussed above and illustrated in FIG. 7*a*, the pivoting latch 112 is easily deflected by applying a force F to the cantilevered end 122 of the size indicator 108*a*, and more particularly, to the dimple 140, to release the size indicator 108*a* from the web 106*a* and allow the indicator 108*a* to be removed from the hanger 100*a*. With the decapping apparatus of the present invention, indicators 108*a* can be automatically removed from their respective hangers 100*a*.

Figure 12:
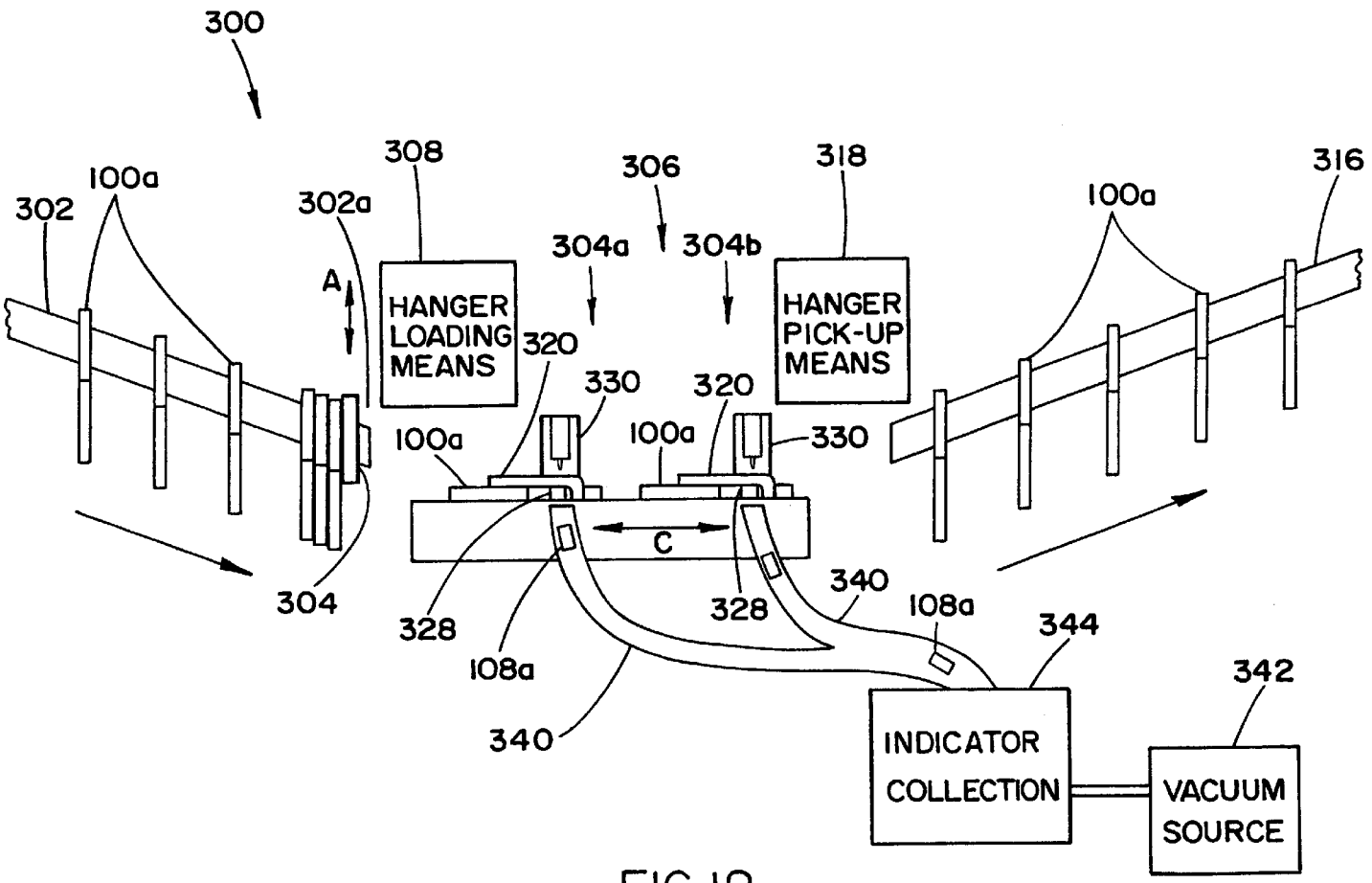
FIG. 12 illustrates a schematic view of a decapping apparatus of the present invention for automatically removing the size indicator from the garment hangers.

In a first embodiment, the hanger 100*a* is fed to the decapping apparatus 300, by means of a feeding rail 302. The feeding rail 302 is inclined so that the hangers 100*a* move downwardly toward the decapping apparatus by gravity. The hangers 100*a* can be put onto the feeding rail 302 manually or automatically. Other means to feed hangers 100*a* to the decapping apparatus could comprise a screw conveyor, a belt conveyor, or any other appropriate means to carry the hangers 100*a* toward the decapping apparatus 300. At an end 302*a* of the feeding rail 302 is a stop means 304, such as one or more movable stop plates which reciprocate in the direction of arrow A to provide a one hanger at a time feed from the accumulated hangers 100*a* at the end 302*a* of the feeding rail 302. The action of the stop means 304 is accomplished by any means known in the art, such as by actuation of a pneumatic cylinder (not shown) attached thereto. A pair of reciprocating stop plates in the stop means 304 will prevent the hangers 100*a* from falling off of the feeding rail 302 when in a blocking position, as shown in FIG. 12. When in the blocking position, the hangers 100*a* accumulate at the end 302*a* of the feeding rail 302. When the stop means 304 is actuated to a feed position, it releases the endmost hanger 100*a* for loading at an indicator removal station 306 by a hanger loading means 308, while simultaneously holding the remainder of the accumulated hangers 100*a* in a load position. The use of a pair of reciprocating stop plates to load one of a plurality of accumulated hangers is disclosed in copending U.S. application Ser. No. 09/255,135, the contents of which is incorporated by reference in its entirety.

Figure 13B:
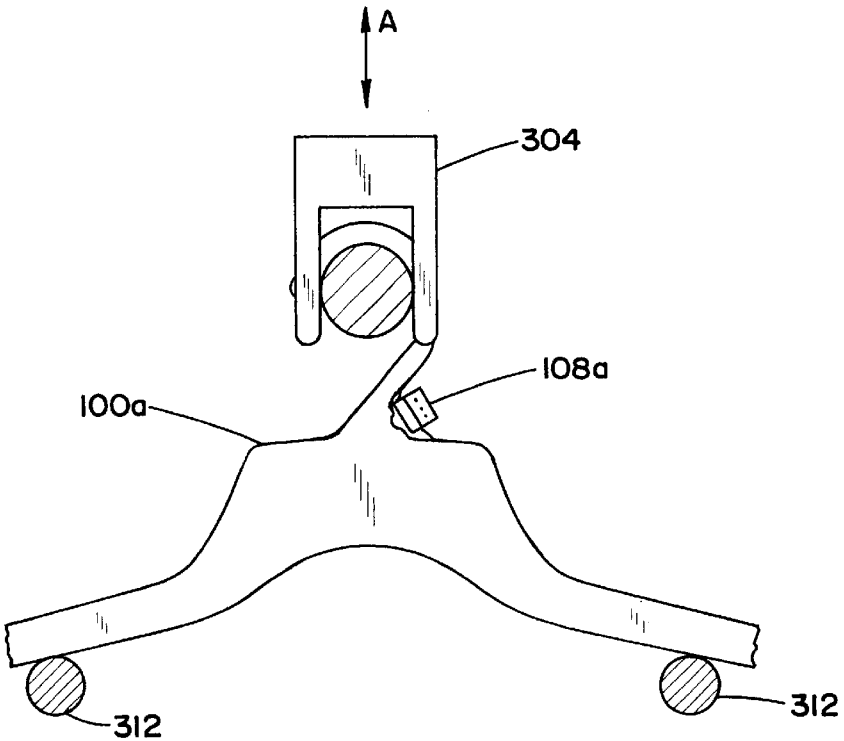
FIGS. 13*a* and 13*b* illustrate a side and front view, respectively, of a preferred implementation of the hanger loading means of FIG. 12.
Figure 13A:
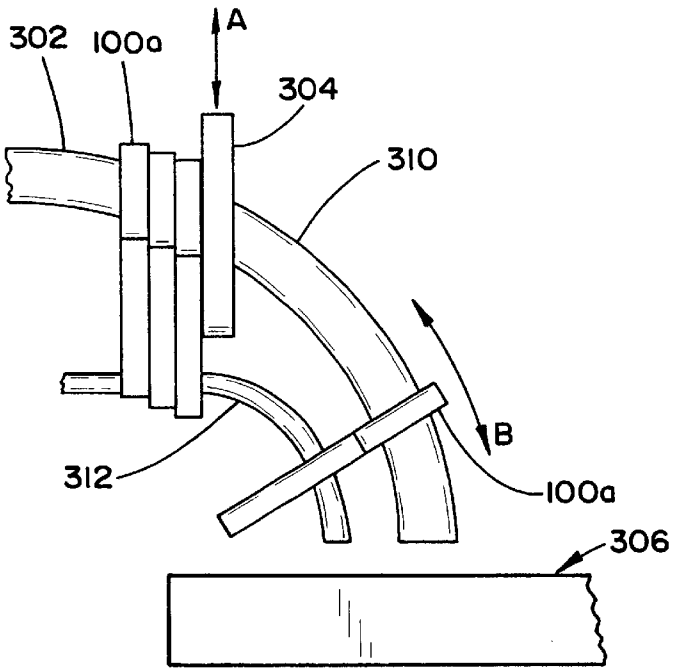

A preferred implementation of the hanger loading means is illustrated in FIGS. 13*a* and 13*b*. The hanger loading means 308 includes a curved feeding rail extension 310 that is curved towards and ends at the indicator removal station 306. The feeding rail extension 310, as with the feeding rail 302, supports the hook 102 portion of the hanger 100*a*. Also included is at least two guide rails 312 which mimic the curve of the feeding rail extension 310 and support the hanger 100*a* at at least two additional points such that the hanger 100*a* cannot rotate or fall off of the feeding rail extension 310. When the stop plate 304 is actuated in the direction of arrow A to the feed position, the end most hanger 100*a* is released and is guided to the indicator removal station 306 in a controlled manner by the feeding rail extension 310 and guide rails 312 in the direction of Arrow B.

Referring back to FIG. 12, the indicator removal station 306 preferably includes an indexing table 314 that is movable along the direction of Arrow C. The indexing table 314 is shown by way of example having two hanger stations 304*a*, 304*b* located thereon. However, those skilled in the art will appreciate that a single hanger station or three of more hanger stations can be provided without departing from the scope or spirit of the present invention. In general, after the hangers 100*a* are loaded on the indexing table 314, they are retained thereon, preferably by clamping, and are positioned to locate the dimple 140 on the pivoting latch 112 of the hanger 100*a* in a registered position to enable automatic actuation of the removal mechanism. The pivoting latch 112 is then depressed to release the size indicator 108*a*, the size indicator 108*a* is collected, the decapped hanger 100*a* is removed and the process repeats with the loading of the next in line of the additional hangers 100*a*. Where multiple hanger stations 304*a*, 304*b* are utilized on the indexing table 314, the indexing table 314 moves in the direction of arrow C towards the feed rail 302 where a first hanger 100*a* is loaded at station 304*b*. The indexing table 314 then moves in the direction of arrow C away from the feed rail 302 for each subsequent hanger 100*a* to be loaded thereon. Preferably, the decapped hangers 100*a* are removed from the indexing table 314 in a similar fashion. The first decapped hanger 100*a* at station 304*b* is removed and the indexing table 314 moves in the direction of arrow C away from the feeding rail 302 for each subsequent decapped hanger 100*a* to be removed.

The decapped hangers 100*a* are preferably removed by way of a removal rail 316, which is preferably a screw conveyor rail. The decapped hangers 100*a* are loaded onto the removal rail 316 by a hanger pick-up means 318. The hanger pick-up means can be any means known in the art for locating and transporting articles from a first station to a second station. Preferably, the hanger pick-up means 318 is mechanical and includes a robotic pick-up arm (not shown) which engages a portion of the hanger 100*a* on the indexing table 314, picks up the engaged hanger 100*a*, swings the hanger 100*a* towards the removal rail 316, and releases the same onto the removal rail 314. Alternatively, a computer vision system (not shown) can be used to locate the decapped hanger 100*a* on the indexing table 314 to enable automated pick up of the hanger, such as with a robotic gripper under the control of the computer vision system, and transport the decapped hanger 100*a* to the removal rail 314 and place it thereon.

Figure 14:
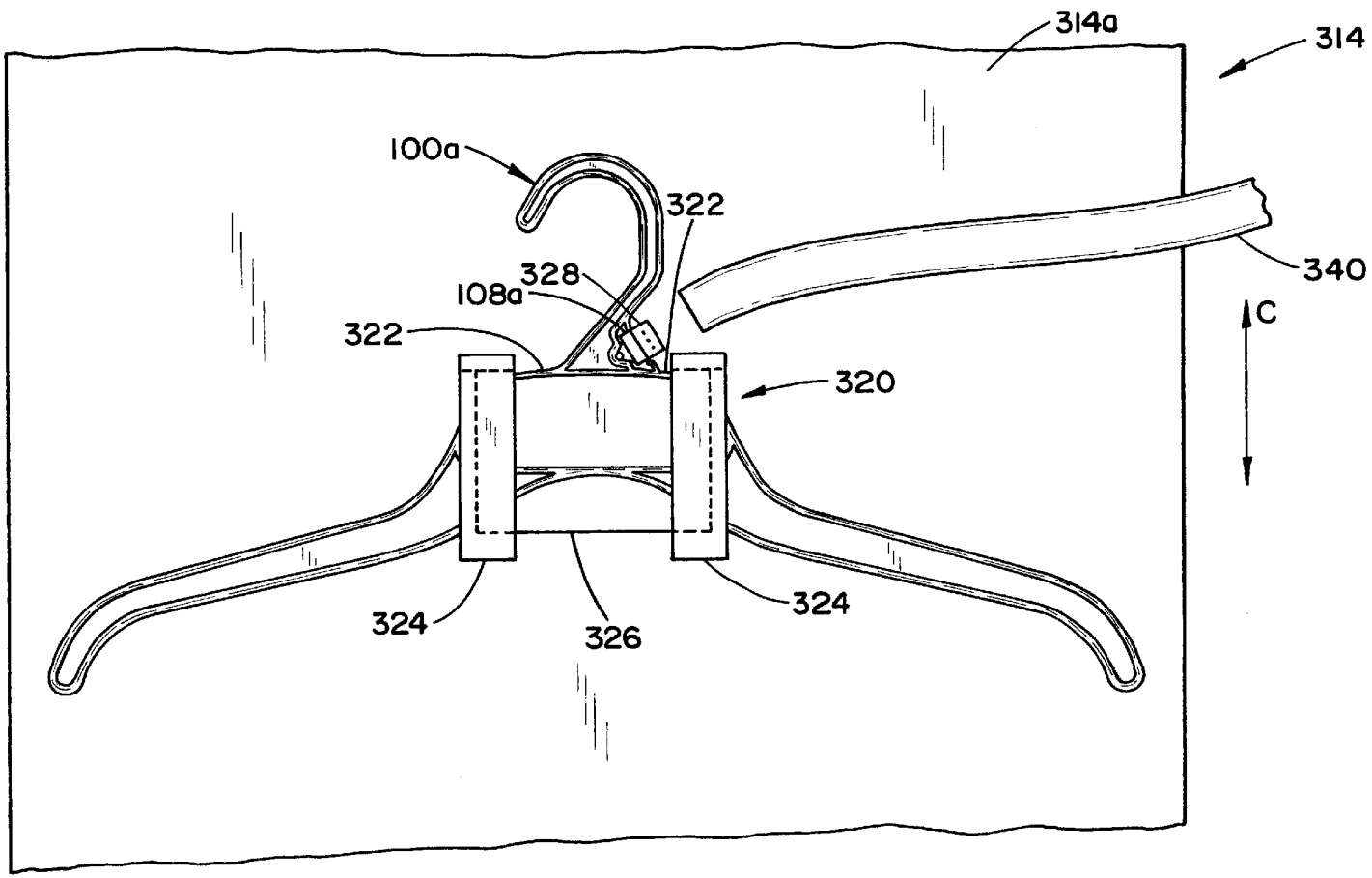
FIG. 14 illustrates plan view of a garment hanger retained on the indexing table of FIG. 12, the pin plunger means not shown therein for the sake of clarity.
Figure 15:
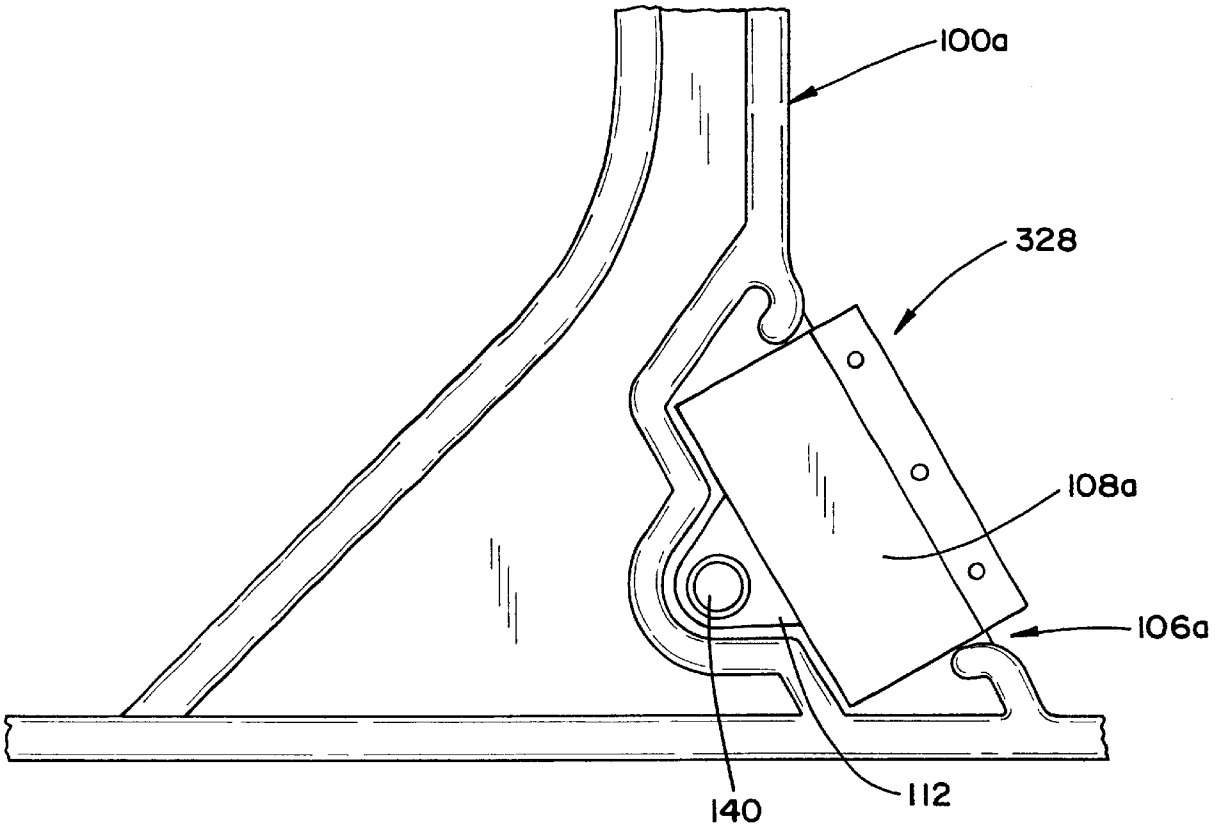
FIG. 15 illustrates an enlarged plan view of the size indicator and corresponding web portion of the garment hanger of FIG. 14.
Figure 16:
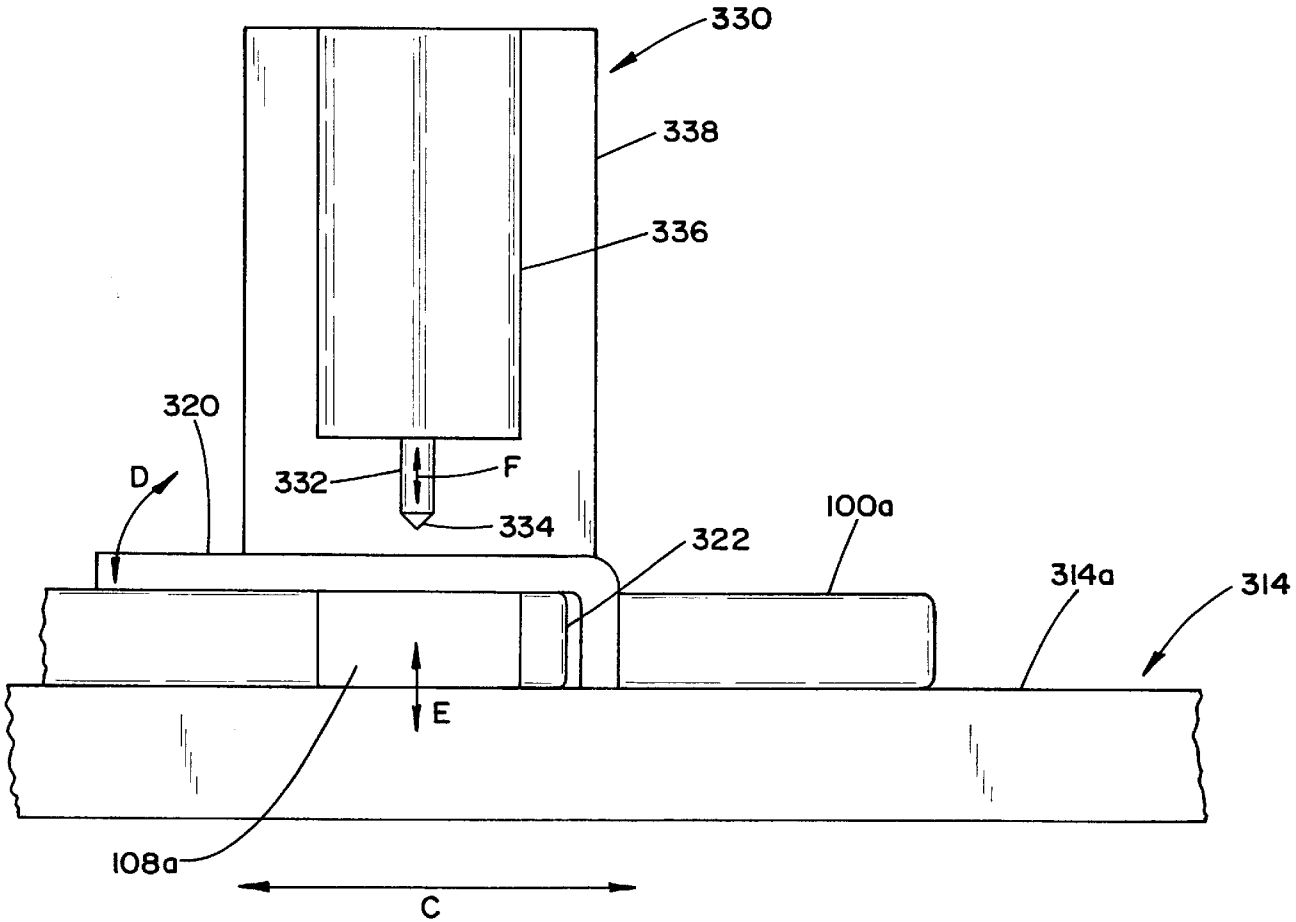
FIG. 16 illustrates a side view of the indexing table and garment hanger of FIG. 14 as well as the pin plunger means omitted from FIG. 14.

Referring now to FIGS. 14–16, a preferred implementation of the indexing table 314 will be discussed in more detail. FIG. 14 illustrates a hanger 100*a* having a size indicator 108*a* disposed on a top surface 314*a* of the indexing table 314. FIG. 14 is shown without the pin plunger means for the sake of clarity, such pin plunger means will be discussed fully below with respect to FIG. 16. After being released onto the top surface 314*a* of the indexing table 314, the hanger 100*a* is retained therein, preferably by a clamp plate 320. Preferably, the clamp plate 320 is rotatable about the direction of arrow D (as shown in FIG. 16) to clamp the hanger 100*a* about its shoulders 322. The loading of the hanger 100*a* onto the indexing table 314 by the hanger loading means 308 is such that it is accurately positioned for clamping by the clamp plate 320 and no further positioning is necessary. However, although not preferred, if the hanger 100*a* were loaded in a rough position on the indexing table 314, a positioning means (not shown) can be provided for positioning the hanger 100*a* such that the shoulders 322 (or other locating portion) corresponds with the clamp plate 320. The clamp plate 320, as shown in FIG. 14 is u-shaped having two forks 324 and is preferably moved along direction D by a rotatable pneumatic cylinder (not shown).

Since many types and sizes of hangers are preferably decapped by the decapping apparatus 300, it is necessary to further locate the size indicator 108*a* on the hanger 100*a*, which may be at different positions on different types and styles of hangers 100*a*. If only a single style hanger 100*a* in which the size indicator 108*a* is located at the same position on the hanger 100*a* is being processed by the decapping apparatus 300, the clamping plate 320 can be utilized alone to position and locate the dimple 140 of the pivoting latch 112. A preferred means for locating the size indicator 108*a* is attachment of the clamp plate 320 (along with its actuation means) on a locating means 326 such as a rotatable cylinder or x-y table, which are preferably pneumatically actuated. Preferably, the locating means 326 moves the hanger 100*a* until a location plate 328 contacts the size indicator 108*a*. The location plate 328 preferably is actuatable into and out from the top surface 314*a* of the indexing table 314 along arrow E (as shown in FIG. 16). The location plate 328 is preferably actuated between a drop-out position so as not to extend past the top surface 314*a* of the indexing table 314 when the hangers 100*a* are being loaded onto the indexing table 314 and a locating position to protrude from the top surface 314*a* of the indexing table 314 after the hangers 100*a* are clamped to the top surface 314*a* of the indexing table 314 by the clamp plate 320.

Many different styles of hangers 100*a* will have the size indicator 108*a* in a similar area on the hanger 100*a* and oriented in a similar direction. Therefore, when decapping similar styles of hangers 100*a,* the rough location of the location plate 328 relative to the size indicator 100*a* is generally known and the movement of the locating means 326 can be minimized. If very dissimilar hanger types are decapped, computer vision means can be utilized for locating the size indicator 108*a,* such as by shape or color difference, and the locating means 326 actuated accordingly to position the hanger 100*a* to correspond to the location plate 328 or directly with the pin plunger means (discussed below). FIG. 15 illustrates the hanger 100*a* having its size indicator 100*a* located against the location plate 328.

Referring now to FIGS. 12 and 16, once the size indicator 108*a* has been located and positioned with respect to the location plate 328, the position of the dimple 140 is known. The location plate 328 is then actuated in the direction of arrow E to the drop out position to expose the size indicator 108*a*. A pin plunger means 330 is utilized to release the size indicator 108*a* from the web 106*a*. The pin plunger means 330 includes a pin 332 having a tip 334 which corresponds to the dimple 140. The pin 332 is actuatable in the direction of arrow F between a retracted position, shown in FIG. 16 and an extended position, in which the tip 334 engages the dimple 140 to release the size indicator 108*a* from the web 106*a* of the hanger 100*a*. The actuation of the pin 332 is preferably carried out by a pneumatic cylinder 336 that is supported on the top surface 314*a* of the indexing table 314 by a bracket 338.

After actuation of the pin to the extended position to release the size indicator 108*a* from the hanger 100*a,* the size indicator 108*a* is collected, preferably by means of a vacuum tube 340 positioned to accept the size indicator 108*a* therein once it is released from the web 106*a* of the hanger 100*a*. The vacuum tube 340 is operatively connected to a vacuum source 342 and a containment vessel 344 for collection of the collected size indicators 108*a*. After removal of the size indicator 108*a* from the hanger 100*a,* referred to herein as decapping the hanger 100*a,* the hanger 100*a* is released from the indexing table 314 by actuating the clamp plate 320 to rotate about direction D away from the top surface 314*a* of the indexing table 314. The released and decapped hanger 100*a* is then removed from the indexing table 314 and placed on the removal rail 316 as discussed above. After all of the hangers 100*a* on the indexing table 314 have been decapped and removed, the indexing table 314 moves in the direction of arrow C towards the feeding rail 302 where additional hangers 100*a* are loaded onto the hanger stations 304*a,* 304*b* of the indexing table 314 as discussed above and the process is repeated.

In an alternative embodiment of the decapping apparatus, the hangers 100*a* are decapped at an indicator removal station located on a feeding rail or other conveying means. Thus, in the alternative embodiment, the hangers 100*a* are decapped without having to be loaded and removed from an intermediate location, such as the indexing table 314. In the alternative embodiment, the hangers 100*a* can momentarily stop or slow down at the indicator removal station of the feed rail for removal of the size indicator 108*a,* or the components of the indicator removal station, discussed below, can travel with the garment hangers 100*a* while the garment hangers are being decapped.

In the alternative embodiment, each garment hanger 100*a* that enters the indicator removal station (which is a designated portion of the feeding rail) is retained against relative movement with respect to the feeding rail. Such retention of the garment hanger 100*a* is preferably accomplished by way of a clamp which is pneumatically actuated to hold the hanger 100*a*. After the hanger 100*a* is retained against relative movement, cameras are used to image the hangers 100*a* as they enter the indicator removal station. The cameras are preferably digital cameras that capture digital image data of the hanger 100*a* and output the same to a recognition system. Alternatively, the cameras can be analog, in which case their output signal is converted to a digital format. The cameras are further preferably fixed and have a field of view sufficient to capture image data of at least the hook and neck portions of the hanger. Alternatively, the cameras can have a pan, tilt, and/or zoom capability under the control of a processor.

The recognition system analyzes the image data of the hanger and determines the region of the size indicator. The recognition system preferably looks for a difference in color, surface finish, and/or shape in making its determination of the size indicator region. Such recognition systems are well known in the art. Since the location of the dimple 140 relative to the size indicator 108*a* is known, the location of the dimple can be easily calculated by the processor from the location of the size indicator 108*a*. Alternatively, the location of the dimple can be determined directly from the recognition system. For example, the dimple can be coated with a different material from the rest of the hanger 100*a* or with a reflective material to make the finding of its location easier for the recognition system. Once the location of the dimple 140 is known, a pin plunger means, similar to the one described above with regard to the first embodiment of the decapping apparatus, is actuated to a corresponding position and the pin is actuated to engage the dimple 140 and pivot the pivoting latch 112 to release the size indicator 108*a* from the web 106*a*. The pin plunger means may also be mounted for x-y movement to allow the pin plunger to move to the x-y coordinates of the dimple 140 as determined by the recognition system. After release of the size indicator 108, a vacuum tube is positioned near the size indicator location and the size indicators are collected for re-use. The decapped hangers 100*a* leave the indicator removal station and continue traveling on the feed rail for further processing, such as packaging.

Although not shown, those skilled in the art will appreciate that the components of the first and alternative embodiments of the decapping apparatus are under the control of a processor, such as a programmable logic controller or a dedicated PC, which controls the actuation and synchronization of the components described above to operate in the manner described. Such processors and their use, including their programming, are well known in the automation arts.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for removing a releasable size indicator from a garment hanger, the garment hanger comprising:

a body having at least one web for removably securing a size indicator to the body, the web having a fixed latch and a pivoting latch; and a size indicator having finger means for engaging the fixed and pivoting latches such that the size indicator is secured on the web during normal use, but wherein the size indicator may be released from the web when the pivoting latch is pivoted out of engagement with the finger means of the size indicator;

the method comprising:

(a) feeding the garment hanger to an indicator removal station;

(b) supporting the garment hanger at the indicator removal station for removal of the size indicator;

(c) depressing the pivoting latch to pivot the same out of engagement with the finger means to release the size indicator from the web;

(d) collecting the released size indicator;

(e) removing the garment hanger from the indicator removal station; and (f) repeating steps (a) to (e) for each of a plurality of hangers sequentially fed to the indicator removal station, wherein at least one of the foregoing steps is automated.

2. The method of claim 1, wherein the feeding comprises feeding the garment hanger on a feeding rail to the indicator removal station.

3. The method of claim 2, wherein the supporting comprises supporting the garment hanger at the indicator removal station at a location on the feeding rail.

4. The method of claim 2, wherein the supporting comprises supporting the garment hanger at the indicator removal station at a location remote from the feeding rail.

5. The method of claim 1, wherein the depressing comprises actuating a cylinder having a pin attached thereto, the pin engaging the pivoting latch upon actuation of the cylinder.

6. An apparatus for removing a releasable size indicator from a garment hanger, the garment hanger comprising:

a body having at least one web for removably securing a size indicator to the body, the web having a fixed latch and a pivoting latch; and a size indicator having finger means for engaging the fixed and pivoting latches such that the size indicator is secured on the web during normal use, but wherein the size indicator may be released from the web when the pivoting latch is pivoted out of engagement with the finger means of the size indicator;

the apparatus comprising:

(a) means for feeding the garment hanger to an indicator removal station;

(b) means for supporting the garment hanger at the indicator removal station for removal of the size indicator;

(c) means for depressing the pivoting latch to pivot the same out of engagement with the finger means to release the size indicator from the web;

(d) means for collecting the released size indicator;

(e) means for removing the garment hanger from the indicator removal station; and (f) means for repeating the release and collection of size indicators for each of a plurality of hangers sequentially fed to the indicator removal station.

7. The apparatus of claim 6, wherein means for feeding comprises means for feeding the garment hanger on a feeding rail to the indicator removal station.

8. The apparatus of claim 7, wherein the indicator removal station is located at a location on the feeding rail.

9. The apparatus of claim 7, wherein the indicator removal station is located at a location remote from the feeding rail.

10. The apparatus of claim 6, wherein the means for depressing comprises a cylinder having a pin attached thereto, the pin engaging the pivoting latch upon actuation of the cylinder.

* * * * *